US005711087A

United States Patent [19]

Pazdera

[11] Patent Number: 5,711,087

[45] Date of Patent: Jan. 27, 1998

[54] APPARATUS FOR PROFILE CONTROL OF A SHEET HAVING A REMOVABLE SCREEN

[75] Inventor: Milo Pazdera, Garibaldi Highland, Canada

[73] Assignee: Measurex Devron Inc., North Vancouver, Canada

[21] Appl. No.: 621,824

[22] Filed: Mar. 22, 1996

[51] Int. Cl.[6] ..... F26B 11/02

[52] U.S. Cl. ..... 34/114; 34/115; 34/122; 34/568

[58] Field of Search ..... 34/114, 115, 116, 34/117, 120, 122, 123, 568

[56] References Cited

U.S. PATENT DOCUMENTS 4,263,824 4/1981 Vits ..... 34/62
4,351,700 9/1982 Dove ..... 162/252
4,398,355 8/1983 Dove ..... 34/54
4,662,398 5/1987 Wywailowski et al. ..... 137/625.4
4,738,196 4/1988 Boissevain ..... 100/93

*Primary Examiner*—Henry A. Bennett
*Assistant Examiner*—Dinnatia Doster
*Attorney, Agent, or Firm*—Christie, Parker & Hale, LLP

[57] ABSTRACT

Apparatus for distributing a heating medium, such as steam or hot air, to a paper web or calendar roll in sheet making machinery includes a removable profile screen to permit easy cleaning and maintenance. The apparatus comprises an elongated chamber to receive steam or hot air from a supply source with a front wall adapted to receive a removable screen. The removable screen is flexible and defines at least a portion of the front wall conforming generally to the shape of the adjacent surface to be heated. The screen member has a plurality of apertures through which the heating medium is forced to heat the surface. The screen is removably mounted to the apparatus by clip members.

15 Claims, 2 Drawing Sheets

APPARATUS FOR PROFILE CONTROL OF A SHEET HAVING A REMOVABLE SCREEN

FIELD OF THE INVENTION

This invention relates to generally to sheetmaking machinery and particularly to apparatus for profile control in sheet making machinery.

BACKGROUND OF THE INVENTION

The sheetmaking industry and particularly the papermaking industry relies on the controlled application of heat using steam or hot air to control the characteristics of the sheet web being manufactured.

For example, application of steam to a paper sheet using steam distribution equipment raises the sheet temperature to provide increased water drainage rates thus reducing the amount of water to be evaporated in the drying section of the papermaking process. In addition, by varying the amount of steam applied to various parts of the sheet in a cross machine direction, the moisture profile of the sheet can be varied to achieve a substantially uniform profile. Applicant is the owner of U.S. Pat. Nos. 4,351,700 and 4,398,355 directed to such apparatus for supplying and distributing steam to a paper sheet.

In caliper control equipment, heated air is used to control the diameter of a calendar roll along its axis by blowing the air at selected cylindrical sections of the roll. The calendar roll expands or contracts with changes in temperature and the roll profile can be adjusted to obtain a more uniform web profile for the thickness of the paper sheet that is fed through the spacing or "nip" formed between a pair of adjacent milers. Applicant's U.S. Pat. No. 4,738,196 discloses a calendar roll diameter controller that uses heated air.

In conventional equipment for applying a heating medium (steam or hot air) to the surface to be heated (paper web or roll), a screen member that conforms substantially to the surface to be heated and that is in close proximity thereto is often employed so that the application of the heating medium to specific areas of the surface can be carefully controlled. The screen member is often provided with an array of apertures through which the steam or heated air is distributed. In existing steam distribution or caliper control equipment the screen is an integral part of the apparatus and this leads to a number of problems. In steam distribution equipment, the screen member is positioned so closely to the sheet web being manufactured, the screen tends to become clogged with wet pulp. In addition, many sites have steam that is contaminated with impurities that tend to clog the screen over time. When it becomes necessary to clean the screen, the equipment must be shut down for an extended period while cleaning of the screen in place occurs. In addition, it is desirable to be able to clean and maintain the profiling chambers behind the screens which is only possible with present equipment when performing an extensive overhaul of the equipment.

SUMMARY OF THE INVENTION

To address the foregoing problems, applicant has developed improved equipment for delivering a heating medium to a surface that employs a removable screen. A dirty screen can be quickly and easily detached from the apparatus and replaced with a clean screen to allow the equipment to be quickly returned to production. The provision of a removable screen significantly reduces down time when compared to conventional equipment where cleaning must be done in place. In addition, removal of the screen permits access to provide chambers behind the screen for regular minor cleaning and maintenance instead of the major overhauls that are necessary with existing equipment.

Accordingly the present invention provides apparatus for distributing a heating medium to a surface to be heated in sheet making machinery comprising:

an elongated chamber to receive a heating medium under pressure from a source in communication with the elongated chamber;

the elongated chamber having a front wall adapted to removably secure a flexible screen member that defines at least a portion of the from wall conforming generally to the shape of the adjacent surface to be heated, the screen member having a plurality of apertures through which the heating medium is forced to heat the surface; and screen retaining members for removably mounting the screen member to the chamber front wall.

In a further aspect the present invention provides, in sheet making machinery having apparatus for controlled distribution of a heating medium to a surface to be heated, the apparatus having a screen member to distribute the flow of the heating medium to the surface, the improvement comprising:

a flexible screen member that is removably mountable to the apparatus; and screen member retaining means for securing the screen member in position.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1A:
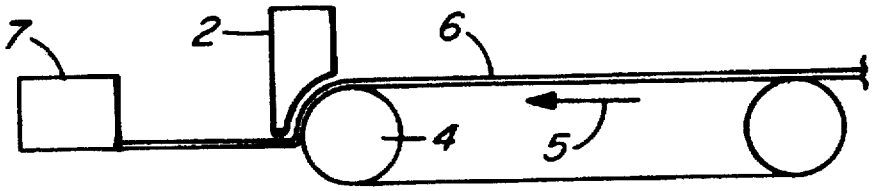
FIG. 1a PRIOR ART
FIGS. 1*a* and 1*b* are schematic views of the arrangement of existing steam distribution equipment in the papermaking process.
Figure 1B:
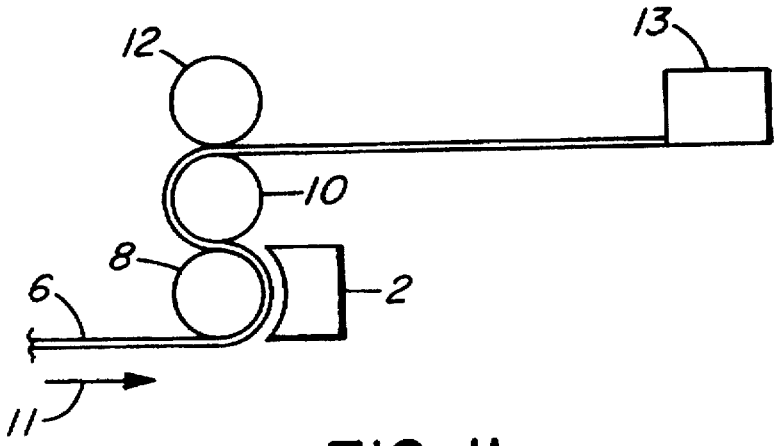
FIG. 1b PRIOR ART
Figure 2:
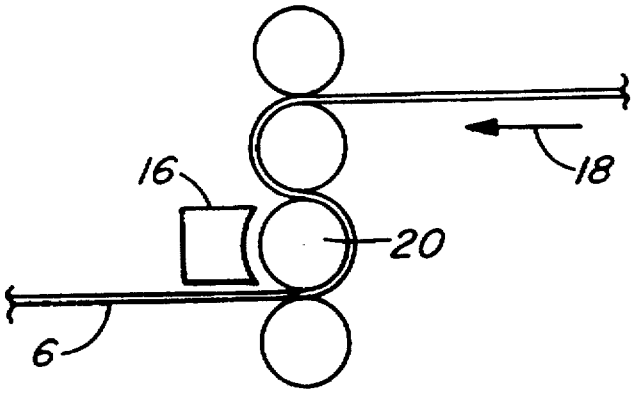
FIG. 2 PRIOR ART
FIG. 2 is a schematic view showing the arrangement of conventional calendar roll profile control equipment.

FIG. 1*a*, 1*b* and 2 show typical locations of steam distribution equipment and caliper control equipment in the papermaking process.

Referring to FIG. 1*a*, steam distribution apparatus 2 is positioned adjacent a roller 4 that supports a wet paper web 6 moving in the direction of arrow 5. The steam distribution apparatus adds moisture to the paper web prior to the web moving through a downstream press section 7. In FIG. 1*b* the steam distribution apparatus is positioned adjacent roller 8. Prior to roller 8, the paper web is supported by a felt 9 and moves in the direction indicated by arrow 11. In this arrangement, steam distribution apparatus 2 is used to raise the sheet temperature to provide increased water drainage rates as the web moves through the stacked rolls 8, 10 and 12 thus reducing the mount of water to be evaporated in the downstream drying section 13 of the papermaking process.

FIG. 2 shows the typical location of caliper control apparatus 16. A paper web from the dryer section 13 is fed through a series of stacked calendar rolls in the direction of arrow 18. Caliper control apparatus 16 directs heated air on metal roll 20 to locally change the roll diameter in control zones. The rolls regulate the thickness or caliper of the paper web in the direction along the axis of the roll (cross machine direction) as the web is compressed in the space or nip between the rolls. Once through the calendar stack the paper web can be wound onto a collection reel for storage of the final paper product.

Figure 3:
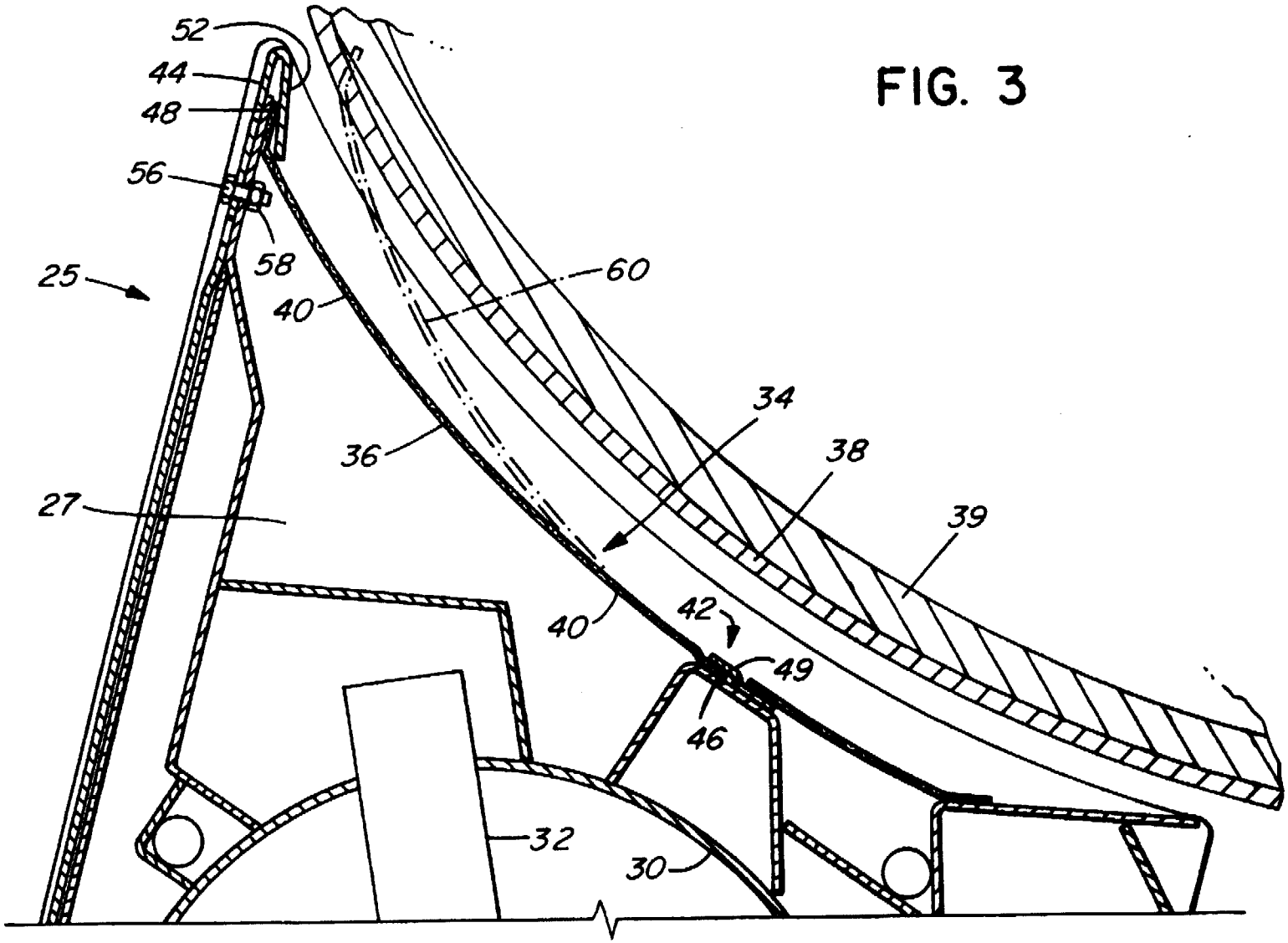
FIG. 3 is a detailed sectional view through a steam distribution apparatus according to the present invention showing the removable green feature.

Steam distribution apparatus 2 and caliper control apparatus 16 are similar in that they function to distribute a heating medium (steam or hot air) to a surface to be heated (paper web or calendar roll). FIG. 3 is a detailed sectional view through apparatus 25 for distributing a heating medium according to the present invention incorporating a removable screen member 36. The illustrated apparatus is intended for steam distribution, however, apparatus for caliper control has a similar general structure and the arrangement of FIG. 3 exemplifies the removable screen structure and its manner of attachment for all heating medium distribution equipment.

In FIG. 3, the apparatus for distributing a heating medium comprises an elongated chamber 27 to receive a heating medium under pressure from a source (not shown) in communication with the elongated chamber. In the illustrated example, steam under pressure is supplied through a header pipe 30 extending the length of chamber 27 and a valve member 32 is provided to release steam from the header pipe 30 to chamber 27. Chamber 27 has a front wall 34 adapted to removably secure a flexible screen member 36 that defines at least a portion of the front wall conforming generally to the shape of the adjacent surface to be heated which in this case is paper web 38 on roll 39. As is conventional, screen member 36 has a plurality of apertures 40 therethrough to allow the heating medium (steam) to reach web 38.

Screen retaining members in the form of first and second clips, 42 and 44, respectively, are provided to removably mount screen 36 to the front wall of the apparatus by engaging the lower and upper edges 46 and 48, respectively, of the screen.

First clip 42 comprises a bracket 49 mounted to a surface of the chamber to define a slot 50 to receive lower edge 46.

Second clip 44 comprises a hook member 52 mounted to chamber wall 54 for slidable movement between a first open position (not shown) to permit removal of the screen member and a second closed position as illustrated to engage and retain upper edge 48 of the screen member between the hook member and chamber wall 54. Locking means comprising threaded fastener 56 that extends through chamber wall 54 and hook member 52 are also provided to lock the book member 52 in the closed position. Threaded fastener 56 is tightenable into nut 58 to lock the clip member against the chamber wall. Slidable movement of hook member 52 is preferably achieved by sliding on the shaft of fastener 56. Preferably, hook member 52 and bracket 49 are arranged as a plurality of separate units along each edge of screen member 39 spaced at a distance to ensure reliable and secure engagement of the screen.

In most applications, heat distribution apparatus 25 and screen member 36 are positionable adjacent a roll 39 and it is preferable that the screen member is deformable into a curved configuration to accommodate the roll. Hook member 52 and bracket 49 are positioned at opposite edges of the screen to deform the screen member into a secured screen shape that is curved to accommodate roll 39. It has been determined that if screen member 36 is preformed with a curvature having a radius that is substantially 80% of the radius of the secured screen shape, the screen member can be easily and efficiently installed into place and secured by the previously described clip members. Furthermore, the deformation of the screen member by the clip members places the screen under tension that aids in reliably seating the screen in the clip members. Dashed lines 60 in FIG. 3 show the curvature of the preformed screen member prior to anchoring by the upper clip member 44.

While FIG. 3 shows removable screen member 36 in place in a steam distribution apparatus, it will be readily apparent to those skilled in the art that the screen arrangement of the present invention can be easily transferred to a caliper control apparatus which has a similar structure to the steam distribution apparatus. In a caliper control apparatus, hot air jets are generally provided for generating hot air to be blown through the screen apertures.

In order to control the cross machine profile of a paper web with respect to a particular characteristic, it is well known to divide the elongate chamber 27 into a plurality of adjacent, separate chambers extending in the cross machine direction to define a plurality of control zones. Distribution of the heating medium is independently controllable in each zone based on feedback from a sensor system downstream of the heat distribution apparatus monitoring the characteristics of the paper web. The removable screen member of the present invention can be dimensioned to cover one or more of the chambers so that the from wall of the heat distribution apparatus is formed from a plurality of removable screens which can be removed individually to clean a particular chamber.

The heat distribution apparatus of the present invention with its removable screen permits quick and efficient removal and replacement of dirty screens with clean screens to minimize downtime of the equipment. The fact that removal of the screens permits periodic cleaning and maintenance of the profile chambers also ensures that the equipment runs at or near peak efficiency.

Although the present invention has been described in some detail by way of example for purposes of clarity and understanding, it will be apparent that certain changes and modifications may be practised within the scope of the appended claims.

I claim:

1. Apparatus for distributing a heating medium to a curved surface to be heated in sheet making machinery comprising:

an elongated chamber to receive a heating medium under pressure from a source in communication with the elongated chamber;

the elongated chamber having a front wall adapted to removably secure a flexible screen member that defines at least a portion of the front wall conforming generally to the shape of the adjacent surface to be heated, the screen member having a plurality of apertures through which the heating medium is forced to heat the surface; and screen retaining members for removably mounting the screen member to the chamber front wall and for deforming the screen member into a curved configuration to accommodate the surface to be heated.

2. Apparatus as claimed in claim 1 in which the heating medium is steam and the surface to be heated is a paper web.

3. Apparatus as claimed in claim 1 in which the heating medium is air and the surface to be heated is a calendar roll.

4. Apparatus as claimed in claim 3 in which the elongated chamber also includes air jet means for generating and directing heated air through the apertures of the screen.

5. Apparatus as claimed in claim 1 in which the retaining members comprise clip members to receive and hold the edges of the screen member.

6. Apparatus as claimed in claim 5 including first and second clip members to engage and retain first and second edges of the screen member.

7. Apparatus as claimed in claim 6 in which the first clip member comprises a bracket mounted to the front wall of the chamber to define a slot to receive the first edge of the screen member.

8. Apparatus as chimed in claim 6 in which the second clip member comprises a hook mounted to a chamber wall for slidable movement between a first open position to permit removal of the screen member and a second closed position to engage and retain the second edge of the screen member between the hook member and the chamber wall.

9. Apparatus as claimed in claim 8 including locking means to lock the second clip member in the closed position.

10. Apparatus as claimed in claim 9 in which the locking means comprises a threaded fastener tightenable against the second clip member to lock the clip member against the chamber wall.

11. Apparatus as claimed in claim 6 in which the first and second clip members are arranged as spaced, separate clips along the first and second edges, respectively, of the screen member.

12. Apparatus as claimed in claim 1 in which the screen member has a preformed radius that is substantially 80% of the radius of the secured screen shape.

13. Apparatus as claimed in claim 1 in which the elongated chamber is divided into a plurality of adjacent chambers extending along the length of the surface to be heated to define a plurality of control zones in which distribution of the heating medium is independently controllable in each zone and in which the screen member is formed from a plurality of independently removable screen members, each screen member being associated with one or more of the control zone.

14. Apparatus in sheet making machinery for controlled distribution of a heating medium to a curved surface to be heated, the apparatus having a screen member to distribute the flow of the heating medium to the surface, the improvement comprising;

a flexible screen member that is removably mountable to the apparatus and deformable into a curved configuration; and screen member retaining means for securing the screen member in position and deforming the screen member into said curved configuration to accommodate the surface to be heated.

15. Apparatus as claimed in claim 14 in which the screen member has a preformed radius that is substantially 80% of the radius of the screen member when secured in place by the screen retaining means.

* * * * *

UNITED STATES PATENT AND TRADEMARK OFFICE

CERTIFICATE OF CORRECTION

PATENT NO. : 5,711,087
DATED : January 27, 1998
INVENTOR(S) : Milo Pazdera

It is certified that error appears in the above-identified patent and that said Letters Patent is hereby corrected as shown below:

Title page,

Item [75] Inventor, change "Garibaldi Highland, Canada" to
-- Garibaldi Highlands, Canada --.

Column 1, line 35, replace "milers" with -- rollers --.
Column 2, line 3, replace "provide" with -- profile --.
Column 2, line 14, replace "from" with -- front --.
Column 2, line 44, replace "green" with -- screen --.
Column 2, line 49, change "FIG. 1a, 1b and 2" to -- FIGS. 1a, 1b and 2 --.
Column 2, line 63, replace "mount" with -- amount --.
Column 3, line 51, replace "book" with -- hook --.
Column 3, line 58, change "member 39" to -- member 36 --.
Column 4, line 28, replace "from" with -- front --.
Column 5, line 11, replace "chimed" with -- claimed --.

Signed and Sealed this

Fifth Day of October, 1999

*Attest:*

Q. TODD DICKINSON

*Attesting Officer*

*Acting Commissioner of Patents and Trademarks*